US006625961B1

(12) United States Patent
Ogier et al.

(10) Patent No.: US 6,625,961 B1
(45) Date of Patent: Sep. 30, 2003

(54) MULTIPLE STATION BAGGING SYSTEM

(76) Inventors: Mark A. Ogier, 3280 CR 811, Green Forrest, AR (US) 72638; Timothy J. Ogier, 13400 Maple Hill Rd., Alpena, AR (US) 72611

( * ) Notice: Subject to any disclaimer, the term of this patent is extended or adjusted under 35 U.S.C. 154(b) by 389 days.

(21) Appl. No.: 09/698,758

(22) Filed: Oct. 27, 2000

(51) Int. Cl.[7] ..... B65B 1/32

(52) U.S. Cl. ..... 53/502; 53/268; 53/273; 53/280; 53/570; 141/144

(58) Field of Search ..... 53/272, 273, 276, 53/278, 280, 502, 503, 570, 268; 141/144

(56) References Cited

U.S. PATENT DOCUMENTS

| | | | | | |
|---|---|---|---|---|---|
| 1,815,766 | A | * | 7/1931 | Floyd | 141/101 |
| 3,348,359 | A | | 10/1967 | Lasbrey | 53/52 |
| 3,406,727 | A | | 10/1968 | Rexus | 141/131 |
| 3,621,629 | A | | 11/1971 | Wickersheim | 53/59 |
| 3,842,569 | A | * | 10/1974 | McClelland et al. | 53/469 |
| 3,995,668 | A | * | 12/1976 | Goodman | 141/34 |
| 4,698,953 | A | * | 10/1987 | Esch et al. | 53/529 |
| 4,706,441 | A | * | 11/1987 | Chervalier | 53/512 |
| 4,789,016 | A | * | 12/1988 | Mihail | 141/143 |
| 4,984,676 | A | * | 1/1991 | Michel | 198/370.04 |
| 5,001,889 | A | | 3/1991 | Mueller | 53/502 |
| 5,010,929 | A | * | 4/1991 | Tisma | 141/1 |
| 5,331,792 | A | * | 7/1994 | Kitchen | 53/502 |
| 5,813,195 | A | * | 9/1998 | Nielsen et al. | 53/443 |

* cited by examiner

*Primary Examiner*—Eugene Kim
*Assistant Examiner*—Christopher Harmon
(74) *Attorney, Agent, or Firm*—Head, Johnson and Kachigian

(57) ABSTRACT

A device for the rapid packaging of various meat products includes at least four bagging chutes that are fed by a rotary chute. Once bags located at the bottom of the bagging chute are filled with a meat product, they are placed on a conveyor belt. The device is designed in such a manner so as to prevent meat products from accidentally falling onto the ground and thus wasting.

2 Claims, 4 Drawing Sheets

MULTIPLE STATION BAGGING SYSTEM

BACKGROUND OF THE INVENTION

1. Field of the Invention

The present invention relates generally to bagging systems for food. More particularly, the present invention relates specifically to a multiple station bagging system for foods packaged in bulk quantities. Relevant known art may be found in U.S. Class 53, Subclasses 459, 573, 493 and 502.

2. Known Art

The food packaging industry has grown tremendously in the recent past. Part of this growth is due to the recent use of thin plastic films as packaging materials for foodstuffs. As will be readily appreciated by those skilled in the art, thin plastic packaging films are widely used in the packaging industry to both package and preserve foodstuffs. Plastic film has been used in the foodstuff packaging industry to further automate the packaging equipment in order to reduce costs while increasing effectiveness.

Many types of packaging machinery are adapted to package foodstuffs in plastic bags. For example, one category of packaging machinery is known as "form, fill and seal machines" because they first form a plastic bag, then fill the bag and finally seal the filled bag, all in a single operation. These devices work well for their intended uses and have provided a high degree of automation in the foodstuff packaging industry. These machines are not without limitation however. A particularly vexatious problem encountered with form, fill and seal machines involves package or film breakage as well as improper fill weights and inadequate sealing.

When the package or film breaks, the foodstuffs contained therein are often contaminated or otherwise destroyed, often at substantial cost to either the packager or retailer of the product. Thus, package or film breakage is undesirable. Improper bag weights are also undesirable as well as inadequate sealing. Both problems often require reopening and reprocessing of the meats and disposal of the bag.

Package or film breakage with form, fill and seal machines is often encountered when excessive weights of foodstuffs are placed in the relatively thin plastic bags typically formed by most form, fill and seal machines. While an apparently simple solution would be to simply increase the thickness of the plastic film used in the form, fill and seal machine, such has not proved a practical method of addressing the problem. Increasing the thickness of the plastic film often results in undesirable side effects to the form, fill and seal machine, such as increased maintenance cost, wasted film from improperly formed bags, increased inefficiencies due to slower machine usage, improper alignment and orientation of the packaging film and the like. Consequently, a need exists in the industry for an effective and very quick machine for putting bulk foodstuffs in plastic bags of increased thickness.

The known art dealing with packaging devices has addressed other issues. For example, U.S. Pat. No. 3,348,359 to Lasbrey relates to a device for transferring an article from a stationary position to a moving tray and into one of a plurality of stationary receivers. The device includes at least one stationary loading tray, at least one moving tray and a plurality of stationary receiving bags in combination with means for driving the moving tray along a path passing beneath the loading tray and above each of the receiving bags or chutes leading thereto. The device also includes means for initiating controlling the transferred article from the loading tray to the moving tray. This device is not used for packaging food nor does it appear to be as quick and efficient as would be required in a conventional food processing facility.

In U.S. Pat. No. 3,346,727 to Rexus shows a portable continuous article bagging machine. The invention includes a rotatable annular series of bag holders with bag filling means superimposed thereover. The filling means are circumferentially adjustable relative to the annualar series so that the point of filling may be pre-positioned at any desired circumferential position. The device also includes means for releasably latching each successive bag holder at the time of filling. This device rotates the bag holders around a stationary filling point. This fills bags at the same location as opposed to moving the output to fill each individual bag. This device is thus prone to problems with contamination due to bag spillage during rotation.

U.S. Pat. No. 5,001,889 to Mueller shows an apparatus for bagging foodstuffs. The apparatus includes a carousel having a number of hopper recesses defined in the top surface. An electric motor and transmission assembly rotatably move the carousel. This device is similar to the Rexus device and would face the same obstacles.

U.S. Pat. No. 3,621,629 to Wickersheim shows an apparatus for packing piece goods into sacks. The apparatus includes a rotary sack holder that holds a plurality of sacks and a transfer container for introducing articles into the sacks. The device coordinates the rotation of the rotary sack holder with the discharge of articles from a transfer container so that the articles are discharged into the sacks in a predetermined orientation. Again, this device suffers similar problems.

None of the known art deals with the need to quickly and effectively fill bulk packages with foodstuffs. In particular, the known art fails to provide a sufficiently automated system that can sustain the pace required by most assembly-line type production systems associated with conventional food processing and/or packaging plants.

A further problem with the known art relates to contamination of the foodstuffs. For example, while it is difficult to contaminate potatoes and other bulk vegetables and/or fruits, meat products are completely different. Current USDA regulations require that meat products touching the floor be condemned and discarded as contaminated and unfit for human consumption. Such contamination is undesirable and is to be avoided if possible. A need exists in the art for an improved packaging system that enables foodstuff packagers to continue current production systems while avoiding food contamination. A need also exists for an efficient device and method that enables plastic bags to continue to be used with such foodstuffs.

SUMMARY OF THE INVENTION

The present invention addresses the perceived needs in the known art. The present invention enables foodstuff packagers to utilize existing thick plastic film bags in an assembly-line configuration. This arrangement permits the foodstuff packagers to maintain current production rates while utilizing minimal manpower to quickly fill thick plastic film bags while preventing contamination of the packaged goods.

The invention includes a large frame that supports several components. The large frame is at least partially surrounded by a contaminate free conveyor system. The frame supports an uppermost automatic scale chute into which the foodstuffs such as meats, including chicken, beef, poultry, fish and the like, are deposited during processing. When an appropriate quantity of meat has been deposited in the scale chute, the meat is transferred by gravity to a rotary chute supported by the frame located at the bottom of the scale chute. The rotary chute includes a downsloping funnel that transfers the meat from the automatic scale chute to a bagging station that is supported by the frame beneath the rotary chute. The rotary chute rotates among multiple bagging stations via an indexing system that keeps it adjustable to keep pace with a desired production rate. The rotary chute may rotate among as many as 12 to as few as two bagging stations.

Each bagging station includes an inclined discharge chute that conducts the dispensed meat from the rotary chute to a bag chute. The discharge chute may include an integral bag chute or the two chutes may be disparate components. The bag chute includes an upper end adapted to receive the meats from the discharge chute and a lower end in communication therewith. The lower end is adapted to temporarily mate with a preformed bag. The bag is placed over the lower end outlet to mate therewith. In one exemplary embodiment, a bag tray is located adjacent the lower end of the bag chute so that an operator may quickly and efficiently pull additional preformed bags from the bag tray without moving from close proximity to the bag chute. Each preformed bag rests upon an associated bag shelf adjacent the lower end of the bag chute. The bag shelf serves to prevent dispensed meats from exiting the bag chute and becoming contaminated by contact with the floor or other areas.

Immediately adjacent the bag shelf is the contaminate free conveyor system. The conveyor system uses a food grade endless chain bounded by stainless steel walls to cooperate with the bag shelf to prevent the meat products from becoming contaminated by falling on the floor or other undesirable areas.

During operation, a user pulls a preformed bag from the bag tray and places the preformed bag at the lower end of the bag chute. When the rotary chute indexes with the discharge chute, the scale chute discharges the dispensed meat into the rotary chute. The rotary chute then conducts the dispensed meat into the discharge chute and thence into the bag chute. Gravity forces the dispensed meats through the chutes and into the bag at the end of the bag chute. The bag is then removed from the bag chute and placed upon the conveyor belt.

Another bag is pulled from the bag tray and the process begins anew as the rotary chute again indexes with a particular discharge chute. The rotary chute ideally rotates among at least four bagging stations and more preferably at least six bagging stations and as many as ten stations. In one exemplary embodiment, the rotary chute sequentially indexes from one to 60 times per minute depending upon production requirements of foodstuffs to a series of discharge chutes placed in a circular configuration. Such an arrangement enables the foodstuff packager to maintain current production line rates.

Thus, a principal object of the present invention is to provide an improved multiple station bagging system that addresses the needs in the art.

Another object of the present invention is to provide a bagging system that enables foodstuff packagers to use existing thick plastic film bags.

Another object of the present invention is to provide an improved bagging system whereby contamination of the foodstuffs is avoided.

Another object of the present invention is to provide an improved bagging system that reduces wastes of the foodstuffs from contamination.

Yet another object of the present invention is to provide a bagging system that may be retrofitted to existing food production lines.

A basic object of the present invention is to provide a semi-automatic system capable of sustaining production rates at conventional food processing plants.

Another basic object of the present invention is to reduce wasted plastic film resulting from overweight bags.

An object of the present invention is to provide a system that enables operators to preserve plastic film and processing efficiency thus reducing film change time and rework of bags with undesirable weight and/or improper seals.

DETAILED DESCRIPTION OF THE PREFERRED EMBODIMENTS

Figure 1:
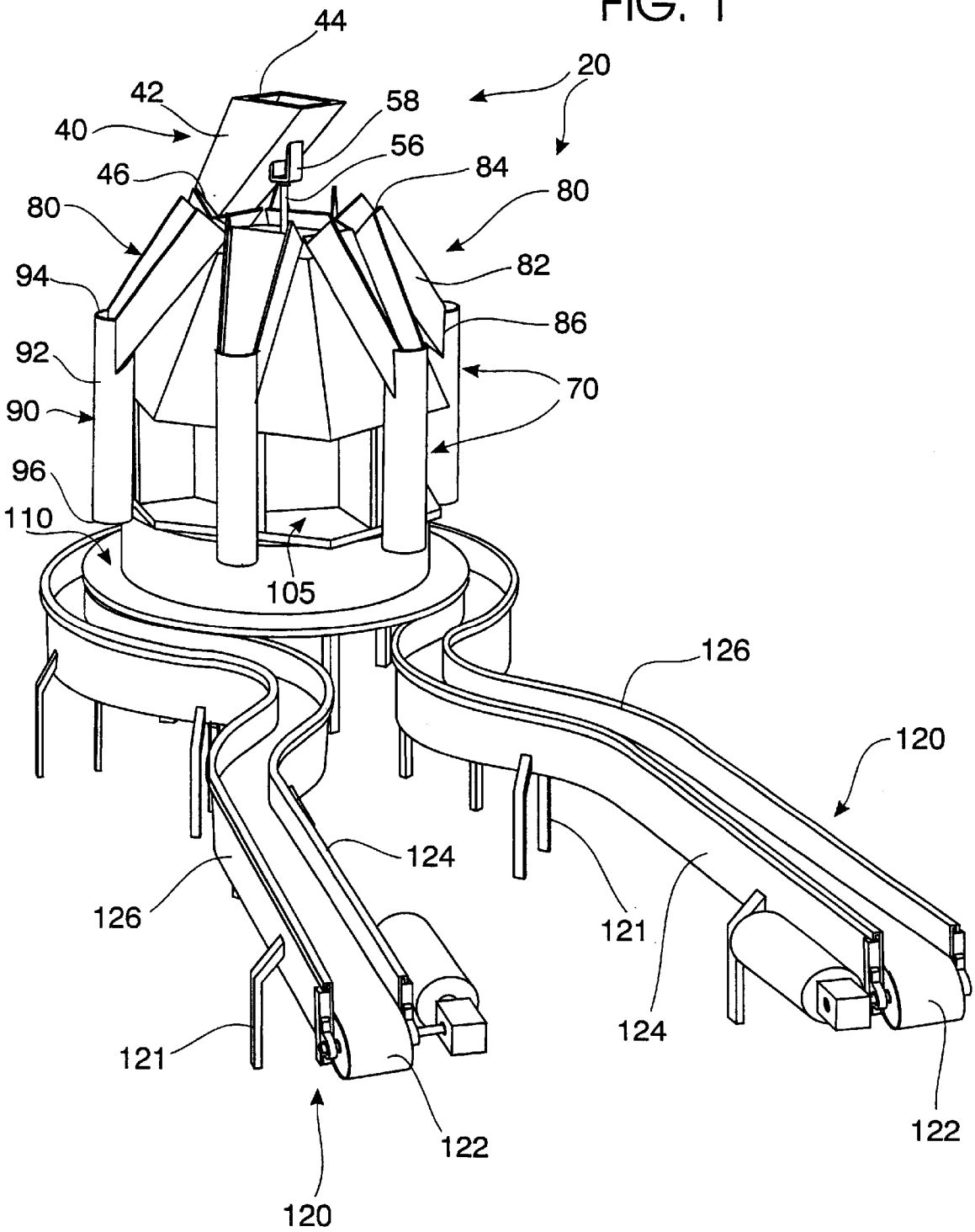
FIG. 1 is a perspective view of a multiple station bagging system.
Figure 2:
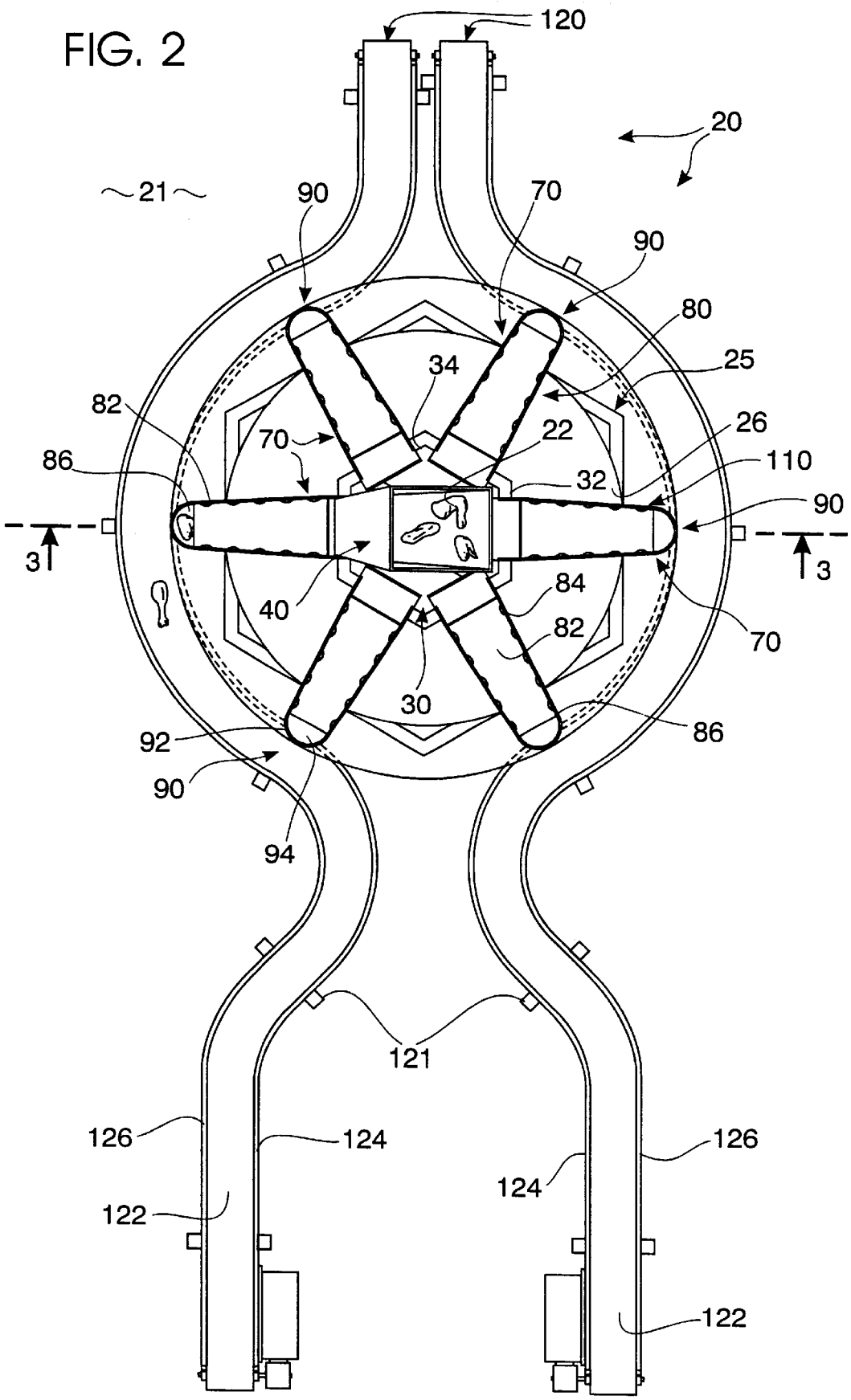
FIG. 2 is a top elevational view thereof.
Figure 3:
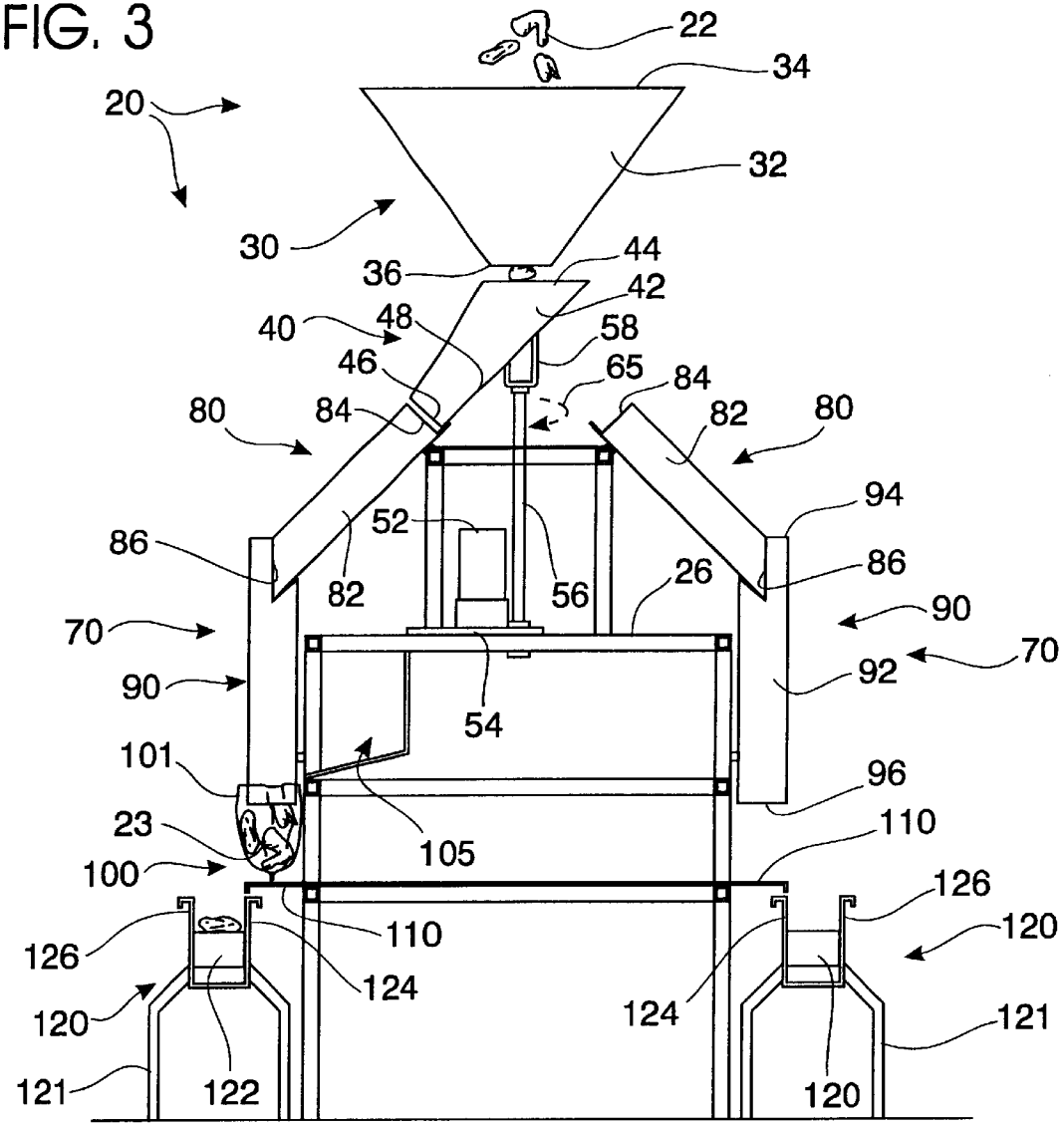
FIG. 3 is a cross-sectioned view taken along line 3—3 in FIG. 2.
Figure 4:
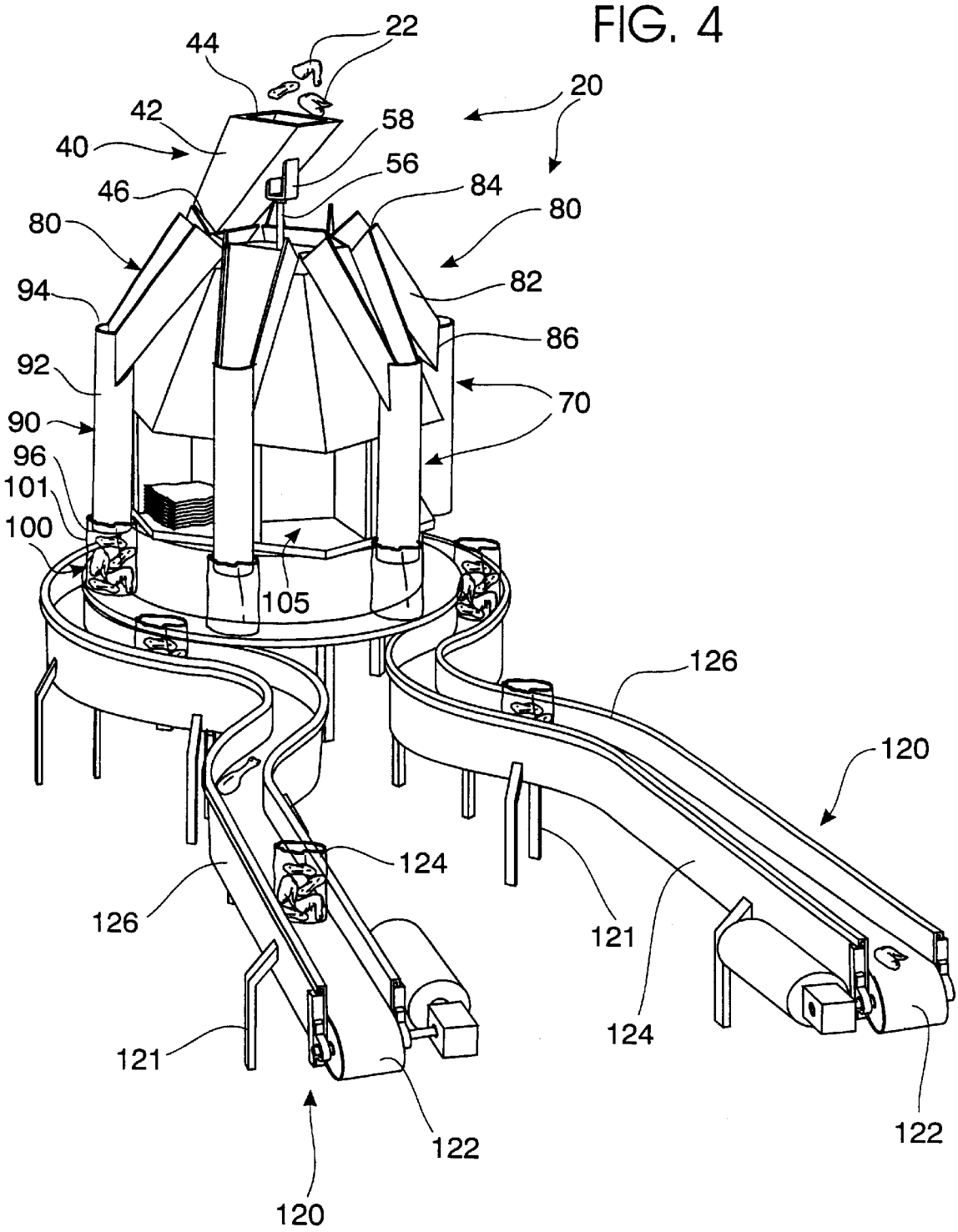
FIG. 4 is a perspective view similar to FIG. 1 but showing the system in operation.

The improved multiple station bagging system 20 addresses problems known in the art. The system 20 enables preformed thick plastic bags to be used for packaging foodstuffs quickly. The system 20 facilitates the use of such preformed bags to package the selected foodstuffs in bulk quantities to facilitate conventional processing.

The invention includes a large frame 25 that supports several components including several bagging stations. The frame 25 is at least partially surrounded by a contaminate free conveyor system 120. Both the frame 25 and the conveyor system 120 rest upon the floor 21 of a processing plant. The frame 25 also supports an upper automatic scale chute 30 into which foodstuffs such as meats 22, including chicken, beef, poultry, fish and the like, are deposited during processing.

The scale chute 30 includes a hopper 32 that may be shaped as a truncated cone, although other shapes would work as well. In one exemplary embodiment, the scale chute hopper 32 includes an open top 34 with a spaced apart lower bottom 36. Bottom 36 includes a movable lid that may be displaced between an obstructionary position retaining meats 22 in hopper 32 and a communication position whereby the meats 22 may be dispensed from the hopper 32. When an appropriate quantity of meat has been deposited in the scale chute 30, the meat is transferred by gravity through bottom 36 to a rotary chute 40 that is supported by frame 25 adjacent the bottom of the scale chute 30.

The rotary chute 40 includes an elongated funnel 42 having an open top 44 and an open bottom 46. A sloping downward surface 48 extends between top 44 and bottom 46. Rotary chute 40 is rotated by an indexing system 50 that is responsive to a conventional weight control system on scale chute 30. The indexing system 50 includes a rotary motor 52 coupled to a motive pulley 54. When active, pulley 54 rotates an indexing shaft 56. Indexing shaft 56 extends upwardly from the internal frame 26 through an upper cover 28 to support the rotary chute 40 on journalled bracket 58.

The rotary chute 40 is rotated between bagging stations 70 in response to the index motor 52, which is controlled by an indexer 60. 54 Discharge chute 80 is located using locator pin 62 attached to discharge chute frame 60 includes multiple locators 62, that are each on cover 28 and that are adjacent to each bagging station 70. The rotary chute 40 uses the elongated downsloping funnel 42 to transfer the dispensed meat from the automatic scale chute 30 to a bagging station 70. The rotary chute 40 may rotate among as many as ten to as few as four bagging stations 70.

The rotary chute 40 rotates among multiple bagging stations 70 that each have a discharge chute 80. Each discharge chute 80 conducts the meat from the rotary chute 40 to a bag chute 90. The discharge chute 80 includes an elongated frame 82 that slopes downwardly from an open end 84 to an open lower end 86. Dispensed meats received from the rotary chute 40 enter through open end 84 and are transferred to the bag chute 90 via open end 86. The discharge chute 80 may be integral with the bag chute 90 or the two chutes may be disparate components.

Each bag chute 90 includes a frame 92 with an upper end 94 adapted to receive the dispensed meats from the discharge chute 80 and a spaced apart lower end 96 in communication therewith. The lower end 96 is adapted to temporarily mate with a preformed bag 100. The bag 100 is placed over the lower end 96 by an operator. In one exemplary embodiment, a bag tray 105 is located adjacent the lower end 96 of the bag chute 90 so that an operator may quickly and efficiently pull additional preformed bags 100 from the bag tray 105 without moving from close proximity to the bag chute 90. Each preformed bag 100 rests upon an associated bag shelf 110 adjacent the lower end 96 of the bag chute 90.

The bag shelf 110 serves to prevent dispensed meats from exiting the bag chute 90 and becoming contaminated by contact with the floor 21 or other areas. Immediately adjacent the bag shelf 110 is a contaminate free conveyor system 120. The conveyor system 120 also prevents the meat products 22 from becoming contaminated by the floor 21 or other undesirable areas.

The conveyor system 120 includes a supporting stand 121 that elevates a food grade endless conveyor chain 122 off the floor 21. The conveyor chain 122 is bounded by a stainless steel inner wall 124 and an outer wall 126 that prevent the dispensed meats from dropping upon floor 21. In one exemplary embodiment, each conveyor 120 dumps unpackaged meats 22 to be reprocessed into a pail or tray or bin so that the dispensed meat may be recycled into the processing system.

OPERATION

During operation, an operator pulls a preformed bag 100 from the bag tray 105 and couples the preformed bag 100 to the lower end 96 of the bag chute 90. When the rotary chute 40 indexes with the respective bagging station 70, the scale chute 30 dispenses meat into the rotary chute 40. The rotary chute 40 then transfers the dispensed meat 22 into the discharge chute 80 and thence into the bag chute 90. Gravity forces the dispensed meats through the chutes 30, 40, 80 and 90 and into the bag 100 at the end of the bag chute 90. The filled bag 101 is then removed from the bag chute and placed upon the conveyor belt.

Another empty preformed bag 100 is then pulled from the bag tray 105 and the process begins anew as the rotary chute 40 indexes with the next sequential discharge chute 80. The rotary chute 40 ideally rotates among at least four bagging stations and more preferably at least six bagging stations and as many as ten. In one exemplary embodiment, the rotary chute 40 sequentially indexes every two seconds to a series of sequentially spaced apart bagging stations 70 in a circular configuration. Thus, the rotary chute indexes every 12 seconds to a particular bagging station 70. Such an arrangement enables the foodstuff packager to maintain acceptable production rates.

Whereas, the present invention has been described in relation to the drawings attached hereto, it should be understood that other and further modifications, apart from those shown or suggested herein, may be made within the spirit and scope of this invention.

What is claimed is:

1. An improved multiple station bagging system for receiving and bagging meats, said system comprising:

an automatic scale chute that receives meats and releases the meats once the volume of meats attains a predetermined weight;

a frame with at least four bagging stations, said frame having means for receiving meats to be bagged and a rotary chute periodically moving between each of said bagging stations to dispense said meats therein, wherein the rotary chute receives released meats from the automatic scale chute;

wherein each bagging station comprises a discharge chute adapted to receive the meats, a bag chute adapted to receive meats from the discharge chute and release the meats into a bag, a bag tray and a bag shelf;

means for coupling bags temporarily to each of said bagging stations to receive said dispensed meat to fill said bags;

a contaminate free conveyor system proximate said bag shelf and adapted to receive said filled bags, such that the close proximity of the bag shelf and the conveyor prevents meats and bags from falling onto the ground, thereby contaminating them; and wherein the automatic scale chute adapted to receive said meats to be bagged and hold said meats to be bagged while said rotary chute is moving until said rotary chute is aligned with one of said bagging stations.

2. An improved multiple station bagging system for receiving and bagging dispensed meats, said system comprising:

a frame with at least four bagging stations, each of said at least four bagging stations comprising a bag chute, a proximate bag tray adapted to store several preformed bags and a shelf adapted to receive a preformed bag and dispose said preformed bag beneath said bag chute so said disposed bag may be selectively filled with said dispensed meat, said frame having means for receiving said dispensed meats to be bagged and a rotary chute periodically moving between each of said bagging stations to dispense said meats therein;

a contaminate free conveyor system proximate said frame and adapted to receive said filled bags, whereby said dispensed meats are protected from contamination during said bag filling and the transfer of said filled bags to said conveyor system wherein said means for receiving includes an automatic scale chute adapted to receive said meats to be bagged and hold said meats to be bagged while said rotary chute is moving until said rotary chute is aligned with one of said bagging stations; and, wherein said conveyor system is disposed adjacent said bag shelf.

* * * * *